US006244596B1

(12) United States Patent
Kondratjuk

(10) Patent No.: US 6,244,596 B1
(45) Date of Patent: Jun. 12, 2001

(54) GAMBLING AND LOTTERY METHOD AND GAMBLING AUTOMATION FOR IMPLEMENTING THE SAME

(76) Inventor: Igor Garievich Kondratjuk, Russian Federation, 121059, Moscow, ul. Bryanskaya, d.4, kv. 9, Moscow (RU)

( * ) Notice: Subject to any disclaimer, the term of this patent is extended or adjusted under 35 U.S.C. 154(b) by 0 days.

(21) Appl. No.: 08/930,653

(22) PCT Filed: Apr. 1, 1996

(86) PCT No.: PCT/RU96/00078

§ 371 Date: Oct. 2, 1997

§ 102(e) Date: Oct. 2, 1997

(87) PCT Pub. No.: WO96/31849

PCT Pub. Date: Oct. 10, 1996

(30) Foreign Application Priority Data

Apr. 3, 1995 (RU) ..... 95104753

(51) Int. Cl.[7] ..... A63F 9/22

(52) U.S. Cl. ..... 273/143 R; 463/16; 463/22; 273/138.2; 273/144 R

(58) Field of Search ..... 463/16, 17, 18, 463/19, 20, 21, 12, 13; 273/138.1, 138.2, 138.3, 142 B, 142 C, 143 R, 144 R, 144 B, 145 B, 145 C, 139, 269

(56) References Cited

U.S. PATENT DOCUMENTS 4,677,553 * 6/1987 Roberts et al. ..... 463/17
4,695,053 * 9/1987 Vazquez, Jr. et al. ..... 273/143 R
4,738,473 * 4/1988 Meloni et al. ..... 283/903
4,995,615 * 2/1991 Cheng ..... 273/292
5,199,710 * 4/1993 Lamle ..... 273/149 R
5,364,100 * 11/1994 Ludlow et al. ..... 273/143 R
5,605,504 * 2/1997 Huang ..... 463/22

FOREIGN PATENT DOCUMENTS

2232107 B1 11/1973 (DE) .
2264625 B2 10/1975 (DE) .
2657835 A1 6/1978 (DE) .
1275697 5/1972 (GB) .
1459391 12/1976 (GB) .
2106292 4/1983 (GB) .
2147773 * 5/1985 (GB) .
2165074 4/1986 (GB) .

* cited by examiner

*Primary Examiner*—J. Harrison
(74) *Attorney, Agent, or Firm*—J. Herbert O'Toole; Hardaway/Mann IP Group

(57) ABSTRACT

A method as well as a gambling machine for performing games and lotteries consists in that a symbol or combination of symbols is picked out by the gambling machine, a player is enabled to pick out the own symbol or combination of symbols, and then machine-picked symbol or combination of symbols is presented to the player. Wherein, a player is given an opportunity to control an impossibility to change the machine-picked symbol or combination of symbols until it is presented to the player. To realize the method the gambling machine has to contain corresponding units. The proposed invention lets player to make sure the random character of the game and absence of any garbling.

25 Claims, 4 Drawing Sheets

GAMBLING AND LOTTERY METHOD AND GAMBLING AUTOMATION FOR IMPLEMENTING THE SAME

TECHNICAL FIELD

The proposed invention belongs to methods and technical implementations for performing lotteries and gambling with a random outcome.

BACKGROUND ART

There are known methods for proceeding of lotteries and games [1–5] in which the game situation with pseudo-random outcome such as in card games, roulette, lottery with winning numbers etc. is created with a gambling machine or computer. In those methods, a player makes a move, i.e. chooses an arbitrary combination of symbols (digits, numbers, characters, cards, roulette wheel zones, lottery card zones etc.) using the gambling machine controls and then the gambling machine picks the winning symbol combination to determine the result of the game. In the case of complete or partial coincidence of those two combinations the player gets an award. But the player can never be sure the game has really been accidental because the machine determines the winning symbol combination after the information of chosen by player combination became available. Thus, the machine may correct the move to its profit violating the random nature of the game. The game can be considered fair and random if only the player can make the move after the winning combination has been chosen by the machine and if the player can make certain the winning combination is unchangeable until the results are shown. It is noteworthy that in some games, like Black Jack, for the sake of the game fairness it's needed to determine and store in the machine unchanged not a winning symbol combination but a sequence of cards in the deck from which the players can pick out cards. Therefore, hereinafter we will refer to a symbol or combination of symbols picked out by the gambling machine for a general consideration.

There is a known method for performing games and lotteries [6] which is the closest to the proposed one in terms of aggregate of essential features. The method is taken as a prototype. In the method, a symbol or symbol combination is fixed in front of the observation window after revolving wheels with symbols plotted on their rims stopped. For the axed symbol or combination of symbols to be protected from seeing by a player the observation window is covered with opaque door until the player makes his own choice of symbols. Then the door is lifted up and the game result is shown.

However, the revolving wheels as the information carrier are hidden away from the observation and a player fails to assure himself the fixed symbol or combination of symbols (a position of the wheels) is still unchanged after the player makes his move and up to the result presentation. By this way the gambling machine may correct the winning symbol and lead the game on behalf of itself violating the random nature of the game.

There is a known gambling machine [6] chosen as the closest analogue (prototype), which contains: the unit for picking out a symbol or combination of symbols by the machine comprising the set of independently revolving fixable wheels with symbols plotted on the rims; the unit for picking out a symbol or combination of symbols by a player; the unit for a demonstration of the machine-picked symbol or combination of symbols to the player comprising an opaque removable screen mounted before of the machine-picked symbols with the possibility of their presentation after the player has made a move. Nevertheless, the wheels are hidden from the player and the player can't assure himself that after the moment the player makes his move and up to the moment of the result presentation the machine doesn't correct position of the wheels in dependence on the player's move and doesn't lead the game on behalf of itself violating the random nature of the game.

The objective of the proposed method and the machine for its realization is to protect a player from potentially unfair game. The attainable technical result enables a player to control an unalterability of that symbol or combination of symbols picked out by the machine until the moment of result presentation.

DISCLOSURE OF THE INVENTION

To achieve this technical result, in the method of gambling and/or lotteries performing, a symbol or combination of symbols is picked out by the gambling machine; a player is enabled to pick out an own symbol or combination of symbols; the symbol or combination of symbols picked out by the gambling machine is presented to the player; the symbol or combination of symbols picked out by the gambling machine is compared with the ones chosen by the player; as a result of such comparision the player's award is determined. Herein, there is enabled player's control of unalterability of the machine-picked symbol or combination of symbols until the moment of result presentation by the way of a player's visual observation of the state of an information carrier with the symbol or combination of symbols fixed on it by the gambling machine.

It's possible to realize the method by the way when fixation of a symbol or combination of symbols by a gambling machine is carried out by choosing an information carrier out of a set of those carriers; each of these information carriers at one side is marked by a symbol or combination of symbols. The control of unalterability of the machinepicked symbol or combination of symbols is carried out by placing symbol-free side of the chosen carrier within a player's field of vision. Presentation of the machine-picked symbol or combination of symbols may be accomplished by delivering of the information carrier to a player. Therein, it's possible to use the following kinds of information carriers:

information carrier in form of a card;

information carrier in form of a lotto element.

A machine-picked symbols or combination of symbols may be fixed by printing on the information carrier, herein, it's possible that:

information carrier in form of as a tape;

information carrier in form of a card;

two-layered information carrier with a dye-stuff between the layers.

The method can be realized by the way when a symbol or combination of symbols is picked by a gambling machine out of those plotted on a rim of at least one of revolving wheels which is stopped in the fixed position, for instance, in front of transparent window. The window can be set out parallel to the wheel's rotation axis and only one machine-picked symbol plotted on the rim, for example, can be seen through it. The control of impossibility for the symbol or combination of symbols to be changed is carried out by observation of invariable position of every wheel through another window placed, for instance, on the side of a wheel's butt-end.

Gambling machine for the method described to be realized is comprising: a unit for picking out a symbol or combination of symbols by the gambling machine; a unit for picking out a symbol or combination of symbols by a player, and a unit for presentation of the machine-picked symbol or combination of symbols to a player. Hereat, a unit for picking out a symbol or combination of symbols by the gambling machine is comprising means for a player to be assured in unalterability of the machine-picked symbol or combination of symbols fixed on, at least, one carrier until the result presentation. Wherein, a unit for picking out a symbol or combination of symbols by the gambling machine may comprise: means for a choice of, at least, one information carrier out of a set of those carriers at one side of which at least one symbol is plotted; and means for a feed of the information carrier by a symbol-free side within the player's field of vision. Hereat, a unit for presentation may comprise means for demonstration either only visually or with direct delivering of the symbol-holding carriers into player's hands. For realization of either the method or gambling machine various carriers can be used. In case of only visual presentation a carrier may be used repeatedly, a player does not receive it in his hands and the articles like chips, cards, cubicles, lotto elements or dominoes seem to be the most expedient. In case of a carrier is delivered directly to a playe—toys, souvenirs, confectionary etc. among mentioned above may be used as a carrier to be placed, for instance, on a transporter belt in a player's visual control zone and then to be delivered to the player.

In another possible realization of the proposed gambling machine, the unit for picking out a symbol or combination of symbols by the gambling machine may comprise means for symbols recording on one side of carrier and a unit for a feed of the information carrier by the symbol-free side in a player's field of vision. It is expedient to use a printer as a recording means. The carrier may be made out of various materials in the form of cards, ribbon, two-layered carrier with a dye-stuff between the layers. The information carrier has to provide for impossibility for a player to determine a machine-recorded symbol or combination of symbols when the carrier is placed in a player's field of vision with the symbol-free side before the moment of result presentation, thus the carrier has to be nontransparent.

There is a possible realization of the gambling machine in which the unit for picking out a symbol or combination of symbols by the gambling machine is comprising: at least, one revolving wheel with a symbol-plotted rim; means for control of an independent rotation and halt of each wheel; a transparent window mounted on the butt-end to observe the unalterability of the wheel position. Additionally, the unit for presentation is comprising a nontransparent screen mounted in such a way as to cover or uncover the machine-picked symbol or combination of symbols.

BRIEF DESCRIPTION OF THE DRAWINGS

Advantages of the proposed invention and possibility of its realization are explained with the references to the attached figures.

DESCRIPTION OF THE PREFERRED EMBODIMENTS

Figure 1:
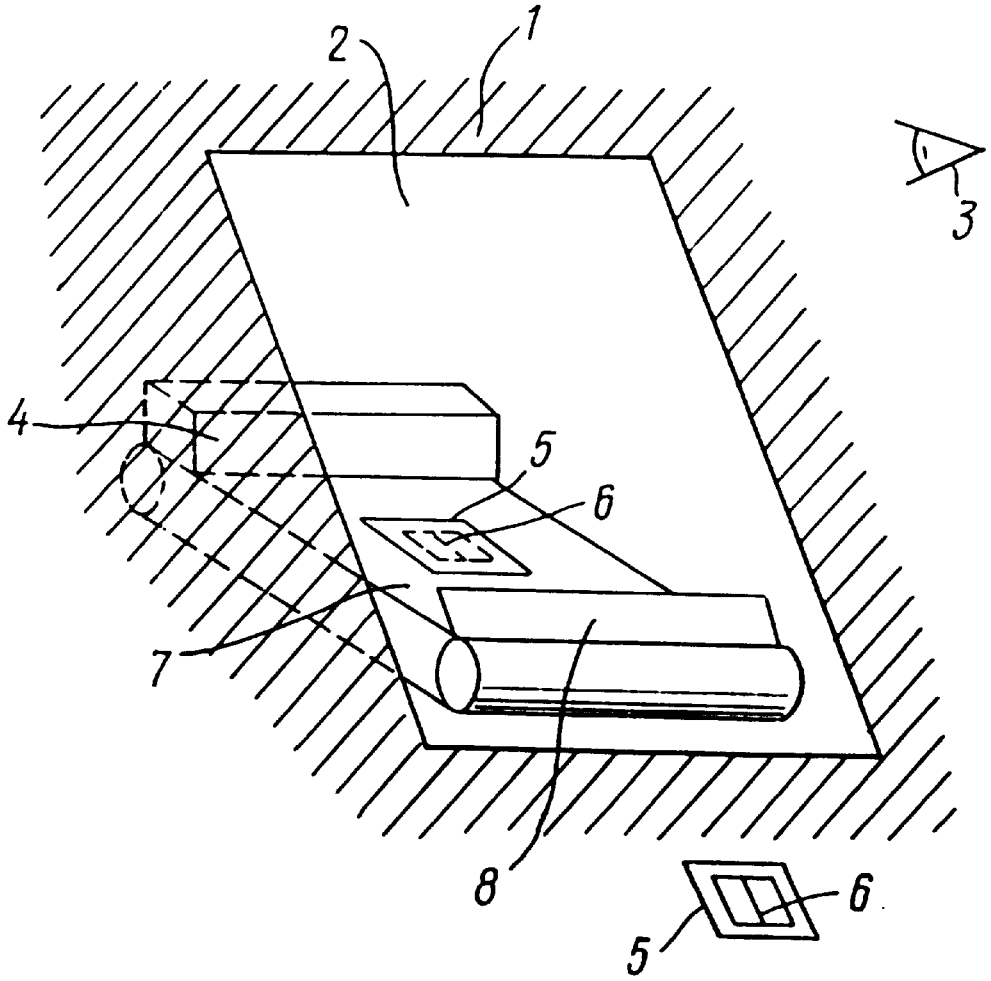
FIG. 1—is a schematic diagram (player's side view) of a gambling machine variant using information carrier with pre-plotted combination of symbols to be delivered directly to a player.

In FIG. 1 there are schematically shown a nontransparent body 1 of a gambling machine and transparent observational window 2 for a visual control by a player 3 situated outside of the gambling machine. Behind the window 2, the unit 4 for picking out a carrier is mounted with a set of information carriers 5 (cards) inside. On the one side of each of the nontransparent card 5 a combination of symbols 6 is preliminary plotted. In the gambling machine, in the player's field of vision, there is also the feeding unit 7 built in the form of belt transporter connected with the unit 4 picking out a carrier and with the means for a carrier delivering, i.e. the output unit 8 enabling the controlled access from outside to the information carrier 5. Various mechanisms of engine-driven gates may be used as the output unit 8.

After a player has paid for a move with a token or credit means (not shown in FIG. 1 for the sake of simplicity) the picking out unit 4 puts the card 5 on the feeding unit 7 with a symbol-free side. Hereby, the player 3 can see only the symbol-free side of the card 5 through the window 2. Various conventional devices like money bills or post envelopes sorters can be used as the unit 4 picking out the information carrier. The picking out unit 4 can read combination of symbols plotted on the next card 5 and thus determine the winning combination of symbols. It is also possible that the picking out unit 4 is registrating only the fact of the following card 5 issue, in the gambling machine control unit (based, for example, on a computer) there was in advance determined the order of cards in the set of carriers 5 and, hence, the sequence of winning combinations of symbols. Then, the feeding unit 7 nioxes the card 5 into the player's 3 field of vision and stops it in the position shown in FIG. I until the player picks out the own combination of symbols. Hereat, the output unit 8 for the carrier delivering is closed and the winning combination 6 plotted on the card 5 is hidden from the player's sight. However, the player can make sure looking through the transparent window that no technical means have an access to the card 5 to change the winning combination of symbols. After the player picks out a combination of symbols using a conventional setting device equipped with either buttons, handles, mouse manipulator, light pen, remote control, touch-sensitive display, etc. the carriers feeding unit 7 removes the card 5 to the opening output unit 8 and delivers the card 5 into the hands of player 3 to check the result.

Figure 2:
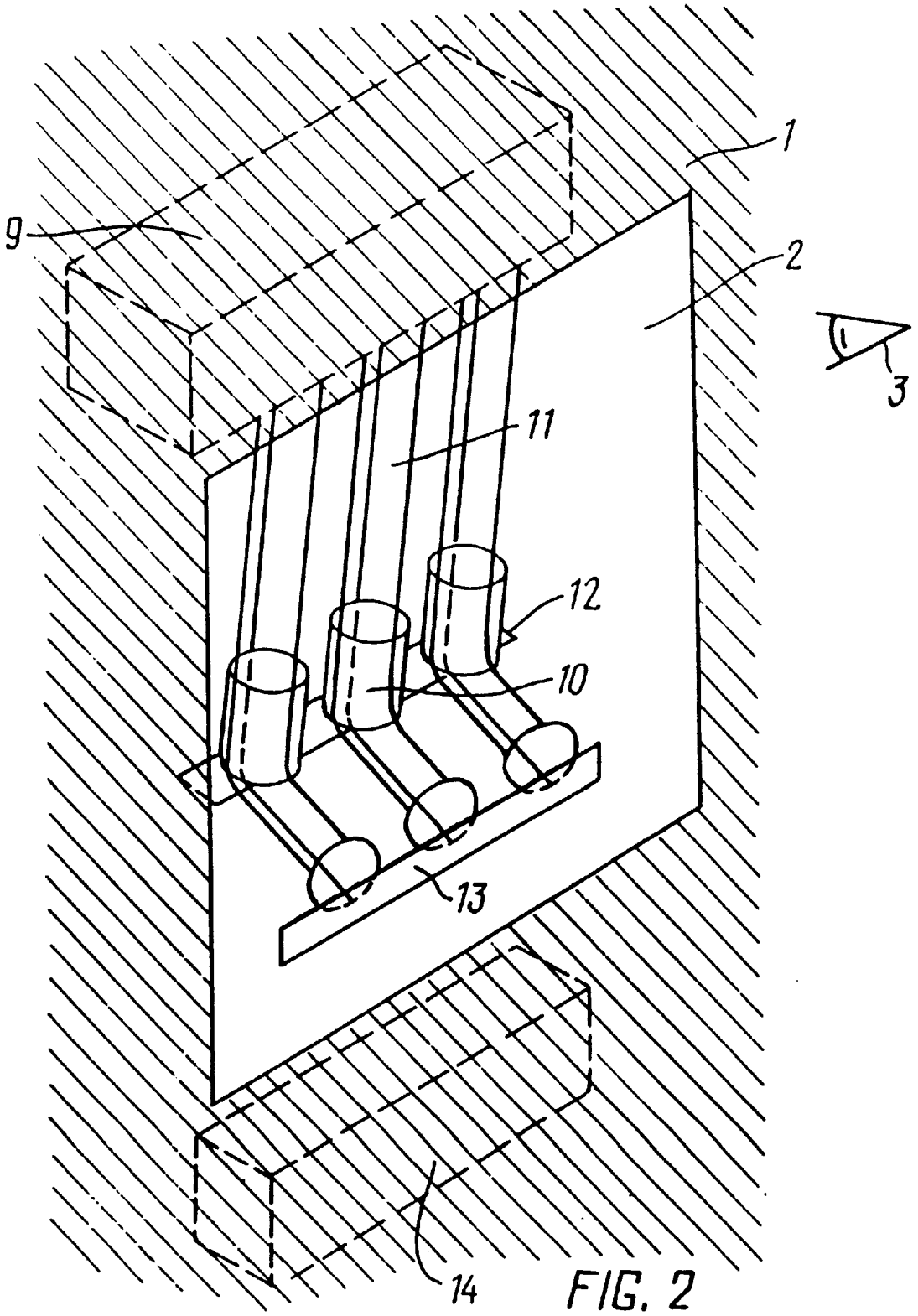
FIG. 2—is a schematic diagram of a gambling machine variant in which a set of information carriers to be presented to a player visually is used.

In FIG. 2 there are schematically shown the nontransparent body 1 of a gambling machine and the transparent observational window 2 for a visual control by a player 3 situated outside of the gambling machine. Behind the window 2, an automated unit 9 for picking out a combination of carriers 10 is mounted. On one side of the each carrier 10 a symbol from the set of symbols is plotted. Cylinder-shaped lotto elements with a symbol plotted on the butt-end can be used as the carriers 10, for example. A unit 9 for picking out a symbol or combination of symbols by the gambling machine can be accomplished, for example, in the form of a mechanism for the carriers 10 shuffling and a gate to let the current combination of carriers 10 pass through. In addition, the combination picking unit 9 is comprising means for reading symbol plotted on each of those carriers 10 let out. In FIG. 2 one of the possible variants of the carrier feeding unit is shown. Under the force of gravity, for example, the carriers 10 advance along a set of guides 11 up to a door 12 and stop in the player's 3 field of vision. The guides 11 and the door 12 are installed in such a way as to hide the fixed combination of symbols from the player (the lower butt-end of the carriers 10 is not visible for the player). However the player can make sure looking through the transparent window 2 that no technical means have an access to the carrier 10 to change the winning combination of symbols. At the end of the guides 11, the door 13 is mounted to stop the carriers 10 in the position enabling the visual presentation of the winning combination on the butt-ends of the carriers 10 to the player. The door 13 is installed in such a way as to enable the carriers 10 to get into the accumulator 14 after the door is opened and to get lifted back into the unit 9 picking out a combination of symbols.

After a player has paid for a move the combination picking unit 9 shuffles the carriers 10 and forwards some combination of them to the guides 11 to move it up to the closed door 12 where they stop in the player's field of vision as shown in FIG. 2. After the player picks out the own combination the door 12 is opened and let the carriers 10 pass to the closed door 13. In that position of carriers 10, the player 3 can read the winning combination and check the result of the game. Then the door 13 is opened, the carriers 10 get into the accumulator 14 and are lifted back into the combination picking unit 9.

Figure 3:
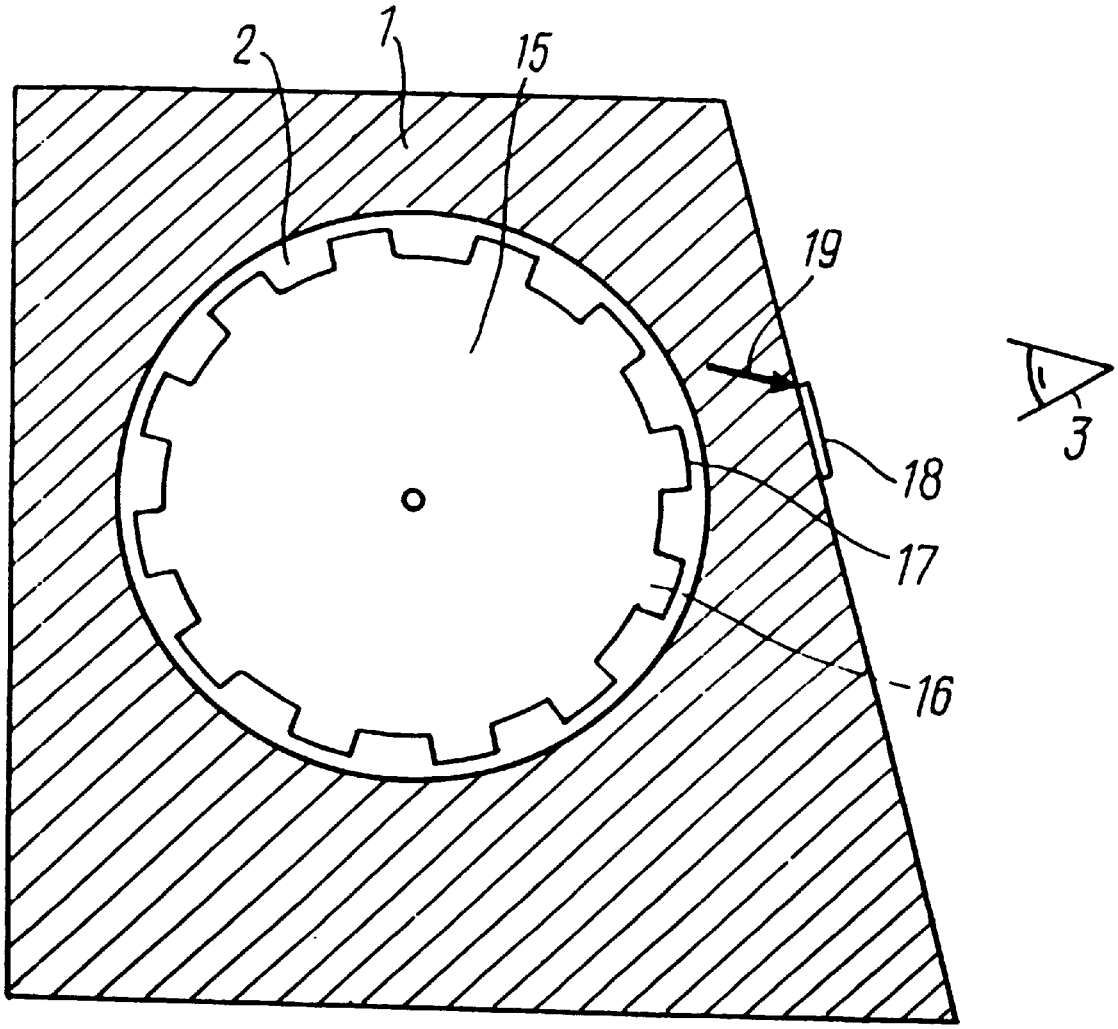
FIG. 3—is a schematic diagram of a gambling machine variant that uses revolving wheels to determine machine-picked symbol combination.

In FIG. 3 there are schematically shown the nontransparent body 1 of a gambling machine and transparent observational window 2 for a visual control by a player 3. Behind the window 2. one or several revolving wheels 15 are coaxially installed (in FIG. 3, the closest to the window wheel 15 is shown). Rims of the wheels have control lugs 16. The wheels have independent drives for a rotation and stop, symbols 17 out of a symbol set are plotted on the lugs 16. In the body 1 of the gambling machine. before the rims of the wheels 15, the transparent read-out window 18 is installed to enable the player 3 to read the winning combination of symbols on the rims of the wheels stopped in front of the window 18. At the initial phase the read-out window 18 is closed by the nontransparent door 19 with a drive (in FIG. 3 the door 19 is shown open). Observational window 2 is installed from the butt-end side of the wheels 15 and has such dimensions as not to let the player read the symbols 17 plotted on the rims but make sure the wheels 15 don't rotate due to the immovable position of the lugs and thus the fixed winning combination of symbols 17 is still invariable.

After a player has paid for a move the drive of the door 19 shuts the window 18, the wheels 15 start independent rotation and then stop in some position thus fixing the winning combination. It is possible to mount a nontransparent extra door on the control window 2 for a some time after the wheels started the rotation to disable the player to find out the winning combination by knowing the initial position of the wheels, sequence of the symbols 17 placement on the rim of the wheel 15 and measuring the rotation angle of the wheel 15. After the player picks out the combination the door 19 opens the read-out window 18 and shows the winning combination to the player.

Figure 4:
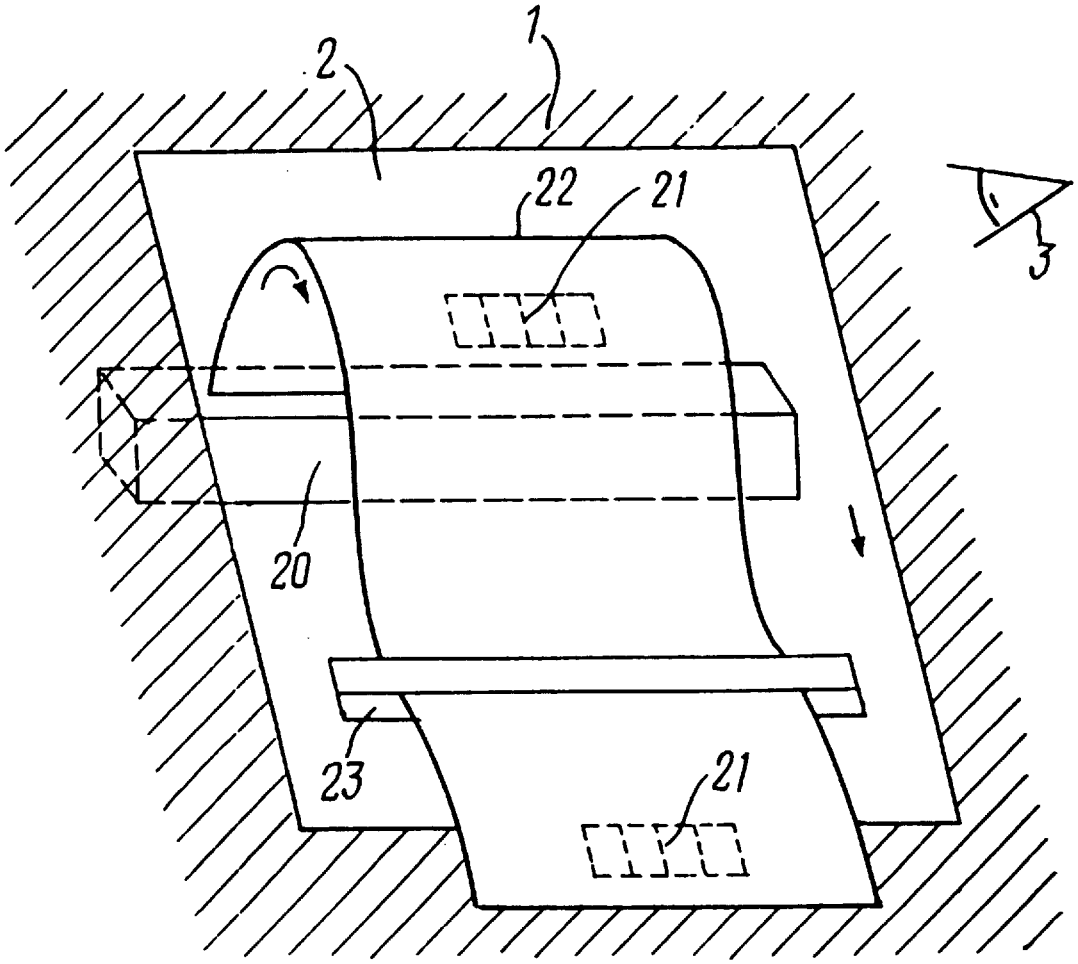
FIG. 4—is a schematic diagram of a gambling machine variant in which a printer to record a symbol or combination of symbols is used.

In FIG. 4, there are schematically shown the nontransparent body 1 of a gambling machine and the transparent observational window 2 for a visual control by a player 3 situated outside of the gambling machine. Behind the window 2 in the gambling machine, the standard (dot matrix, for example) printer 20 is installed for a symbol or combination of symbols 21 to be fixed. The paper tape 22 (for example) can be used as a carrier. The tape 22 can be fed and presented to the player through the cutting unit 23 that is made, for example, in the form of engine-driven sharpened blade with reciprocating movement. In the initial phase the cutting unit 23 shuts an outside access to the tape 22, the printer 20 and the tape are installed in such a way as to print the combination of symbols 21 on the tape side invisible for the player. Therefore, the player cannot read the fixed combination of symbols 21 but can make sure looking through the transparent window 2 that no technical means have an access to the tape 22 to change the fixed combination of symbols 21.

After a player has paid for a move the printer prints out the combination of symbols 21 on the tape 22 and then feeds the segment of the tape 22 with the combination of symbols 21 printed into the player's 3 field of vision as shown in FIG. 4. The arrows show the direction of the tape 22 movement. After the player picks out the own combination the segment of the tape 22 with printed combination of symbols 21 is fed out of the gambling machine and is presented with the cutting unit 23 to let the player check the validity of game.

Of course, in all the given above examples of the proposed invention realization not only combination of symbols but also a single symbol may be offered to guess, as for instance, in games with guessing a number or card, etc. In the given examples, a machine-picked symbol or combination of symbols is called a winning one because a player wins if only a symbol or combination of symbols picked out by the player coincides completely or, at least, partially, with that picked out by the machine. Following the proposed invention, the wide family of games and lotteries with a random outcome can be realized, as for instance, a roulette, a wheel of fortune, various lotto and lotteries, guessing numbers or cards and so on.

Moreover, according to the proposed invention, there is a possibility to realize the card games of Black Jack type, in which cards are identified with numbers (points) and a player or several players has a right to pick an arbitrary number of sequentially arranged cards from a deck in such a way as to collect the maximum sum of points not exceeding 21. To realize the game in accordance to the proposed invention, after the game is paid for, the gambling machine picks out the combination of symbols as an initial sequence of cards in a deck and fixes it on the carrier in any appropriate methods using the devices described above. After that the player or players may take an arbitrary number of consequent cards out from that initial sequence starting from the first one while the gambling machine displays the symbol of the every taken card. In case of the total sum exceeds 21 the player loses both a right to take the next card and a bet equal to the paid game fee. After the player or players have made their moves the gambling machine determines a card combination that is a "dealer" is supposed to take in line with the game rules starting from the first card left by the players. For instance, in Black Jack, a dealer has to take cards until he/she totals 17 points or greater. Then, like it has been in all other above variants of the invention realization, the gambling machine determines according to the rules the result of the game and presents the fixed initial cards sequence to verify the correctness of the results.

INDUSTRIAL APPLICABILITY

The gambling machine, in accordance with the proposed technical solution, can also perform games and lotteries with money winnings and deliver awards in the form of prizes, coins, tokens, credit increase and so on.

Control of the gambling machine and coordination of its units performance can be carried out by standard computer that can also create a game situation, display the results and make an audio background. The computer and its software can also control the units for picking out the symbols combination by a player, keep balance of payments and awards.

SOURCES OF INFORMATION CITED

1. DE, 2264625, G07 F 17/32, published 24.05.74.
2. DE, 2657835, G07 F 17/32, published 22.06.78
3. EP, 219306, G07 F 17/32, published 22.04.87
4. EP, 208857, G07 F 17/32, published 21.01.87
5. WO, 91/032292, A63 F 9/00, published 22.04.87
6. GB, 1275697, G07 F 17/32, published 24.05.72

What is claimed is:

1. A method for lotteries and games of chance performance comprising the sequence of steps of:

picking out one or more winning symbols by a gambling machine;

fixing of said one or more winning symbols using at least one information carrier;

enabling of at least one player to observe the impossibility of change to said one or more winning symbols fixed by said carrier;

enabling of said player to pick out one or more symbols;

presenting of said one or more winning symbols marked on said information carrier to the player for comparison with said player-picked one or more symbols to determine a result of the lottery or game of chance.

2. A method for lotteries and games of chance according to claim 1 wherein said picking out and fixing of one or more winning symbols by a gambling machine comprises the steps of:

choosing at least one carrier from a plurality of carriers having at least one symbol affixed thereto;

feeding said at least one carrier into a player's field of vision with the at least one symbol not visible; and allowing said player to observe the one or more carriers until the player has picked out one or more symbol.

3. A method for lotteries and games performance according to claim 2, wherein said presenting of said one or more winning symbols is carried out by a visual demonstration of said one or more winning symbols to said player.

4. A method for lotteries and games performance according to claim 2, wherein the carrier is a lotto element.

5. A method for lotteries and games of chance performance according to claim 1, wherein said presenting of said one or more winning symbols is carried out by physically delivering said information carrier to said player.

6. A method for lotteries and games performance according to claim 5, wherein the carrier is a card.

7. A method for lotteries and games of chance according to claim 1 wherein said fixing of one or more winning symbols comprises marking said one or more winning symbols on a carrier which carrier is subsequently fed into said player's field of vision.

8. A method for lotteries and games performance according to claim 7, wherein said one or more winning symbols is fixed by a printer.

9. A method for lotteries and games performance according to claim 7 wherein said carrier is a tape.

10. A method for lotteries and games performance according to claim 7, wherein said carrier is a card.

11. A method for lotteries and games performance according to claim 7, wherein said carrier consists of two layers with a dye-stuff between the layers.

12. A method for lotteries and games of chance according to claim 1 wherein said fixing of one or more winning symbols comprises stopping at least one revolving wheel having at least one or more winning symbols carried thereupon behind a nontransparent door and allowing observations of the ends of said wheels to assure the impossibility of change of the one or more symbols.

13. A gambling machine comprising:

means for picking out one or more winning symbols by said gambling machine;

at least one information carrier;

means for fixing of said one or more winning symbol on said carrier, said fixing means providing an opportunity to a player to observe the impossibility of change in the one or more winning symbols fixed;

means for picking out one or more symbols by a player; and means for presentation of said winning symbol or combination of symbols to the player.

14. A gambling machine according to claim 13, wherein:

said means for picking out one or more winning symbols by said gambling machine comprises a unit for picking at least one carrier out of a plurality of said carriers having at least one symbol marked on a side of each carrier; and said fixing means comprises a unit feeding said machine-picked carrier into said player's field of vision showing a symbol-free side.

15. A gambling machine according to claim 14, wherein said carrier is a card.

16. A gambling machine according to claim 14, wherein said carrier is a lotto element.

17. A gambling machine according to claim 13, wherein said means for presentation of the winning symbol or combination of symbols comprises a unit feeding said carrier into said player's field of vision.

18. A gambling machine according to claim 13, wherein said means for presentation of the winning symbol or combination of symbols comprises a unit feeding said carrier to place it at a player's disposal.

19. A gambling machine as set forth in claim 13, wherein said information carrier is at least one revolving wheel with a set of symbols or combination of symbols plotted on a rim, and said means for fixing of one or more winning symbols comprises:

a first drive for separate rotation and halt of each said wheels;

a first transparent window with a nontransparent door installed in front of the rim of said wheel, said door having second drive to close said first window before said winning symbol is fixed in front of said first window;

a second transparent window installed at an end of said wheel to observe the immobility of said wheels until the moment of said presentation;

said means for presentation of the winning symbol or combination of symbols to the player comprises said second drive to open said first window for observation said winning symbol demonstration.

20. A gambling machine according to claim 19, wherein a rim of each said wheels has lugs holding a symbol or combination of symbols.

21. A gambling machine according to claim 13, wherein said means for fixing a symbol or combination of symbols comprises:

a unit for marking symbols on one side of an information carrier;

a unit for feeding said carrier into a player's field of vision with a symbol-free side, whereby said fixing means provides to a player an opportunity to observe that no technical means has access to said carrier to change or to mark new winning symbol or combination of symbols until the moment of said presentation.

22. A gambling machine according to claim 21, wherein the unit for marking symbols is a printer.

23. A gambling machine according to claim 22, wherein the carrier is a tape.

24. A gambling machine according to claim 22, wherein the carrier is a card.

25. A gambling machine according to claim 22, wherein the carrier consists of two layers with a dye-stuff between the layers.

* * * * *